US010648335B2

(12) United States Patent
Bonnemaison et al.

(10) Patent No.: US 10,648,335 B2
(45) Date of Patent: May 12, 2020

(54) TUNNEL BORING MACHINE BACKUP TRAIN COMPRISING MEANS FOR CONVEYING AN ARCH SEGMENT

(71) Applicant: BOUYGUES TRAVAUX PUBLICS, Guyancourt (FR)

(72) Inventors: Quentin Marie Christophe Bonnemaison, Paris (FR); Bastien Simon Papot, Longjumeau (FR); Vincent Stephane Laurent Viallet, Ouerre (FR)

(73) Assignee: BOUYGUES TRAVAUX PUBLICS, Guyancourt (FR)

( * ) Notice: Subject to any disclaimer, the term of this patent is extended or adjusted under 35 U.S.C. 154(b) by 0 days.

(21) Appl. No.: 16/020,877

(22) Filed: Jun. 27, 2018

(65) Prior Publication Data

US 2019/0003305 A1 Jan. 3, 2019

(30) Foreign Application Priority Data

Jun. 28, 2017 (FR) ..... 17 55954

(51) Int. Cl.
*E21D 11/40* (2006.01)
*E21D 11/08* (2006.01)

(52) U.S. Cl.
CPC ..... *E21D 11/40* (2013.01); *E21D 11/08* (2013.01); *E21D 11/403* (2013.01)

(58) Field of Classification Search
CPC ..... E21D 11/40; E21D 11/403; E21D 11/08
USPC ..... 405/146, 150.1, 151
See application file for complete search history.

(56) References Cited

U.S. PATENT DOCUMENTS 3,678,694 A * 7/1972 Haspert ..... E21D 11/40 405/146
3,812,679 A * 5/1974 Ruemmele ..... E21D 11/08 405/138
3,972,200 A * 8/1976 Scarpi ..... E21D 9/04 405/141
4,629,362 A * 12/1986 Kainuma ..... E21D 11/40 405/146

FOREIGN PATENT DOCUMENTS

CN 104265334 * 1/2015
DE 29816075 U1 1/2000
FR 2275638 A1 1/1976
(Continued)

OTHER PUBLICATIONS

Preliminary Research Report and Written Opinion received for French Application No. 1755954, dated Mar. 13, 2018, 8 pages (1 page of French Translation Cover Sheet and 7 pages of original document).

*Primary Examiner* — Frederick L Lagman
(74) *Attorney, Agent, or Firm* — Womble Bond Dickinson (US) LLP

(57) ABSTRACT

A trailer of a backup train of a tunnel boring machine includes a rolling means configured to allow movement of the trailer on a circulation route, a chassis including a lower portion including the rolling means and an upper portion, opposite to the rolling means, conveying means, fixed in the lower portion of the chassis, the conveying means being configured to move at least one support along the trailer, the support being configured to transport at least one arch segment along the chassis.

15 Claims, 9 Drawing Sheets

(56) References Cited

FOREIGN PATENT DOCUMENTS

| | | | |
|---|---|---|---|
| GB | 1504394 | A | 3/1978 |
| JP | 07-197796 | A | 8/1995 |
| JP | 10-280896 | A | 10/1998 |
| JP | 11-030096 | A | 2/1999 |
| JP | 2006-200296 | A | 8/2006 |

* cited by examiner

TUNNEL BORING MACHINE BACKUP TRAIN COMPRISING MEANS FOR CONVEYING AN ARCH SEGMENT

FIELD OF THE INVENTION

The invention relates to a trailer of a backup train for a tunnel boring machine.

TECHNOLOGICAL BACKGROUND

Tunnel boring machines are known which include a large movable structure consisting of a large movable workshop in front of which is disposed a shield having a cross-section compatible with the future cross-section complying with the final shape of the tunnel (tunnel with a circular, two-lobe, rectangular section . . . )

The anterior portion of the shield which comes into contact with the working face to perform the cutting of the geological formation through which the tunnel passes includes a cutting head supporting working tools and driven in rotation at a predetermined speed which depends on the nature of the ground to be excavated.

Behind the shield, the tunnel boring machine includes a backup train, also known under the designation of back-up, which moves forward at the same time as the cutting head during the boring of the tunnel.

This backup train moves on a circulation route resting on the concrete shell of the tunnel and is composed of several trailers (or wagons) containing different operating modules, such as for example power supply units, hydraulic systems, ventilating air supply devices or even sanitary facilities.

In order to allow the transit of equipment necessary for the operation between the outside and the backup train, a passage is provided in the lower portion of the trailers so as to allow the circulation of a Multiservice Vehicle MSV for conveying arch segments and other consumables (spare parts, pipes, equipment baskets, etc.) from the rear of the backup train to the shield.

It is therefore necessary to provide, within each trailer, a passage of sufficient size to allow the introduction and the circulation of an MSV, which penalizes the general bulk of each trailer, these also having to transport the operating modules. Moreover, current regulations require the presence of maximally rectilinear corridors allowing evacuation, if necessary, of operators working on site, and more particularly from the shield of the tunnel boring machine. It is also necessary to provide additional corridors for the maintenance of equipment and the transport of parts. These corridors and this passage consequently intrude on the space available for the operating modules.

Finally, the circulation of the MSV within the trailers causes safety problems, the operators having a tendency, or being constrained, depending on the models and sizes of tunnel boring machines, to pass by the same circulation route as the VMS. Such joint activity, however, is not acceptable from the safety standpoint.

Document JP H11 30096 describes a trailer of a backup train of a tunnel boring machine conforming to the preamble of claim 1. More precisely, the trailer comprises a cart mounted on rollers and configured to transport arch segments by moving on a chassis situated in the lower portion of the trailer. To this end, the cart is guided along the trailer using rails, extending on either side of the cart, and moved by the wheels.

SUMMARY OF THE INVENTION

One objective of the invention is therefore to propose a solution to the problems described above, and more particularly a trailer comprising a greater space to allow the passage of operators and maintenance operations, without however penalizing its capacity to transport operating modules, and which also allows simplification of the logistical operations and limiting the risks of joint activity, thus increasing the safety level within the backup train during operation.

To that end, the invention proposes a trailer of a backup train of a tunnel boring machine comprising:

rolling means configured to allow movement of the trailer on a circulation route, a chassis including a lower portion comprising the rolling means and an upper portion, opposite to the rolling means, conveying means, fixed in the lower portion of the chassis, said conveying means being configured to move at least one support along the trailer, said support being configured to transport at least one arch segment along the chassis.

Preferably, the conveying means comprise two superimposed routes of the double rail or conveyor type.

Certain preferred but non-limiting features of the trailer described above are the following, taken individually or in combination:

the conveying means extend between the rolling means of the trailer.

the conveying means comprise at least one rail and/or at least one conveyor.

the trailer comprises at least two rails extending parallel to one another, preferably two pairs of rails extending in parallel two by two, the two pairs of rails being superimposed.

the conveyor is a chain-link type conveyor, the support then being configured to be fixed to the conveyor and driven by said conveyor.

the trailer comprises a central corridor configured to allow circulation of an operator, said central corridor extending above the conveying means.

According to a second aspect, the invention also comprises a backup train of a tunnel boring machine comprising at least one trailer as described above.

Certain preferred but non-limiting features of the backup train described above are the following, taken individually or in combination:

the backup train comprises at least two trailers and a connecting bridge configured to connect the conveying means of one of the trailers to the conveying means of the other of the trailers so as to allow the transfer of at least one arch segment along the two trailers via their respective conveying means.

the conveying means of the two trailers each comprise at least one rail and in which the connecting bridge between said rails comprises a portion of rail fixed to each of the rails by means of mechanical joints including a sliding joint and at least one of the following joints: a single pivot joint, a double pivot joint, a ball joint.

the backup train comprises a rotating plate configured to receive a support configured to transport at least one arch segment along the chassis, said rotating plate being configured for turning the support so as to facilitate gripping by an erector of an arch segment carried by the support.

the conveying means comprise two superimposed pairs of rails, the rotating plate also being configured to move the support vertically and transfer it from one of the pairs of rails to the other.

According to a third aspect, the invention proposes a tunnel boring machine comprising a backup train as described above.

BRIEF DESCRIPTION OF THE DRAWINGS

Other features, aims and advantages of the present invention will appear more clearly upon reading the detailed description that follows, and with reference to the appended drawings given by way of non-limiting examples and in which.

DETAILED DESCRIPTION OF AN EMBODIMENT

Figure 1:
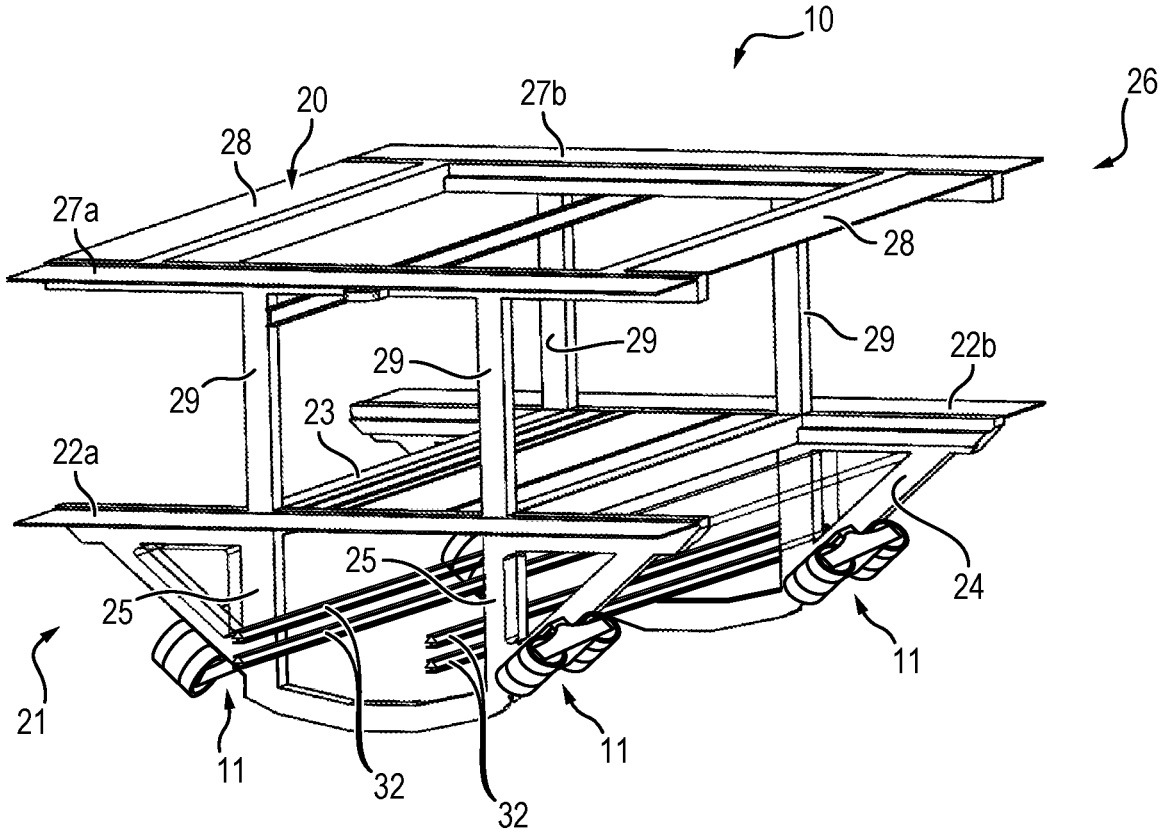
FIG. 1 is a perspective view of an exemplary embodiment of a trailer which can be used in the invention, on which the support has been omitted.

Conventionally, a tunnel boring machine 1 comprises, in the front portion, a shield 2 having a substantially circular cross section the diameter of which corresponds to the diameter of the tunnel which is being bored. The shield 2 is provided with a cutting head which comes into contact with the working face to bore the tunnel.

The tunnel boring machine 1 also includes a backup train 3 extending behind the shield 2 and which moves forward at the same time as the cutting head during the boring of the tunnel. The backup train 3 moves on a circulation route 5 resting on the concrete shell formed of arch segments 7 of the tunnel.

The backup train 3 is composed of several trailers 10 (or wagons) which comprise the different operating modules 6. Customarily, but in a non-limiting manner, the backup train 3 comprises several trailers 10: one suspended trailer (also called a "bridge") 8, connected to an erector (which is part of the shield) and configured to install the arch segments 7 against the wall cut by the cutting head, four or five central trailers 10 comprising operating modules 6 and two rear trailers 9 configured to load the arch segments 7 into the backup train 3.

Hereafter, "rear" will designate the portion of a trailer 10 or of a backup train 3 farthest from the shield 2, in opposition to "front" which will designate the portion of the trailer 10 or of the backup train 3 closest to the shield 2, when the trailer 10 is part of a tunnel boring machine 1.

A trailer 10 conforming to the invention comprises:

rolling means 11 configured to allow the movement of the trailer 10 on the circulation route 5, a chassis 20 including a lower portion 21 comprising the rolling means 11 and an upper portion 26, opposite to the rolling means 11, conveying means 30, attached to the lower portion 21 of the chassis 20, said conveying means 30 being configured to move at least one support 40 along the trailer 10, said support 40 being configured to transport at least one arch segment along the chassis 20.

The trailer 10 is therefore used directly for transporting arch segments 7 from the rear of the backup train 3 by cooperating with a support 40, without necessitating the use of an MSV 4. This therefore allows a strong reduction in the size of the passage required to allow the supplying and the return of the arch segments 7, because a simple support 40 moving or being moved along the conveying means 30 is sufficient. The volume thus spared can be used for creating one or more corridors for the operators, maintenance operations or even transporting parts.

The trailer 10 can comprise a support 40.

In one embodiment, each central trailer 10 comprises conveying means 30 fixed in their lower portion 21 so as to allow the movement of the support 40 of the rear portion of the central trailer 10 farthest from the shield 2 toward the front portion of the central trailer 10 closest to the shield 2. The conveying means 30 of a given trailer 10 are therefore connected to the conveying means 30 of the following trailer 10 so as to allow the transfer of the support 40 from one trailer 10 to the other.

It will of course be understood that several supports 40, each transporting one or more arch segments 7, can therefore be transported by the backup train 3 simultaneously. The central trailers 10 therefore form storage zones 7 for the purpose of their takeover by the erector which will then deal with their attachment against the wall of the tunnel which is being bored.

This configuration can allow, depending on the size of the tunnel, the storage in the backup train 3 of at least the totality of the arch segments required to create a complete ring of the tunnel.

The rear trailers 9, for their part, can either comprise conveying means 30 or a recess configured to receive a MSV 4 so as to supply arch segments 7 up to the central trailers 10 and allow their loading onto the support(s) 40 of the central trailers 10.

The rolling means 11 can be conventional and comprise bogies for example.

The supports 40 are adapted to be moved by the conveying means 30 along the trailer 10, or as a variant to move along the conveying means 30 along said trailer 10.

For example, the conveying means 30 can comprise at least two superimposed paths. For example, the paths can be formed by rails or a conveyor.

In a first embodiment illustrated in FIGS. 4*a* to 5*c*, the conveying means 30 comprise at least one rail 32. The support 40 then comprises means configured to cooperate with the rail 32 and thus allow the movement of the support 40 along the rail 32. The support 40 can be placed on the rail 32, in which case the arch segment 7 can be placed on the support 40, or as a variant be suspended on said rail 32, in which case the arch segment 7 is fixed to the support 40.

In one embodiment, the conveying means 30 comprise two parallel rails 32 and the support 40 comprises a cart comprising the associated movement means, for example wheels 42 of the railway wheel 42 type comprising a tread surface, at least one flange (preferably two) and a tire. In this embodiment, the support 40 is therefore placed on the rails 32. Preferably, the rails 32 extend in a horizontal plane (parallel to the ground).

Figure 4A:
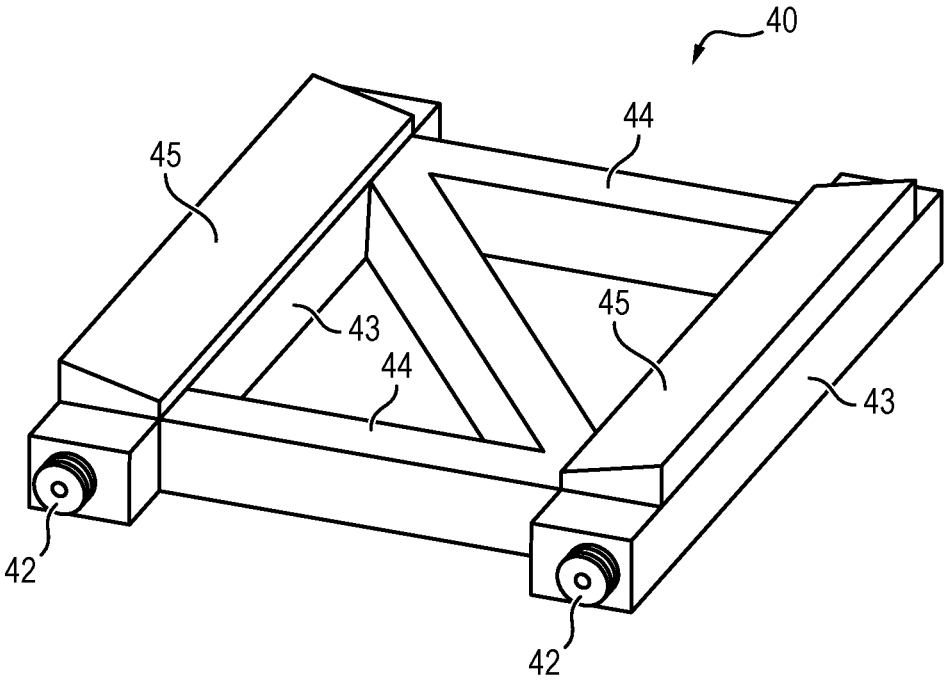
FIGS. 4*a* and 4*b* illustrate a first and a second exemplary embodiment of a support configured to carry an arch segment and capable of being used with a trailer conforming to the invention.
Figure 4B:
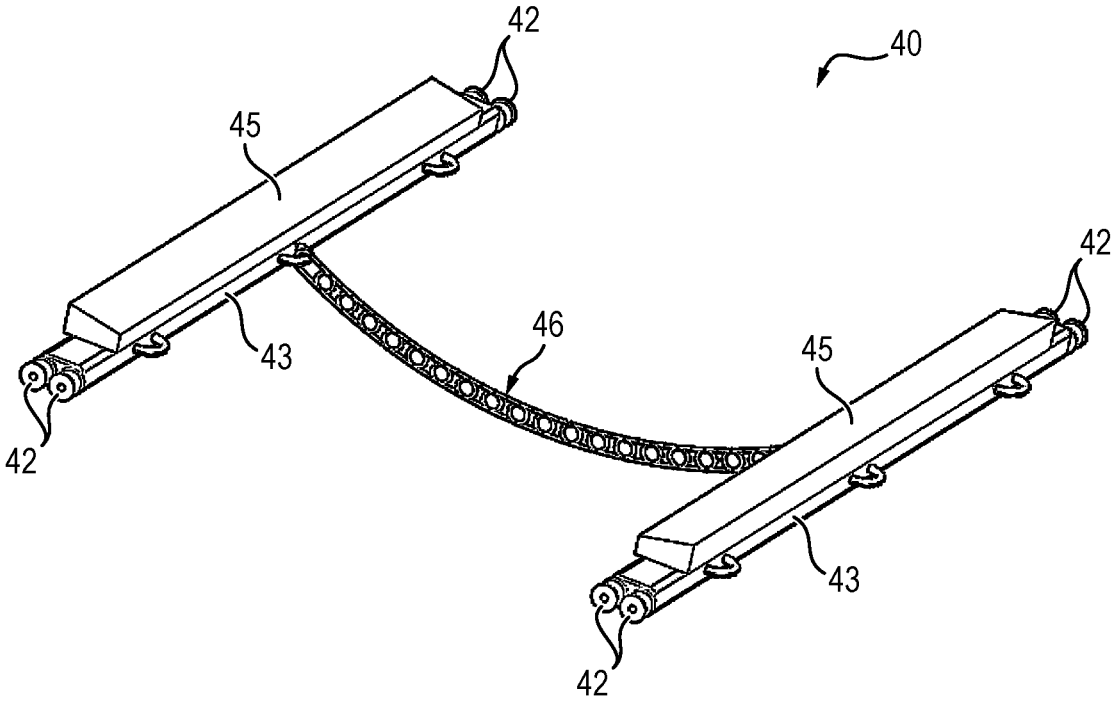

Illustrated for example in FIGS. 4*a* and 4*b* are two exemplary embodiments of a cart which can serve as a support 40.

In the example of FIG. 4*a*, the cart 40 comprises a base including two parallel bars 43 at the end of each of which are fixed one or two railway wheels 42. The bars 43 are connected to one another by one or more cross-members 44 making the cart a one-piece construction. The cart 40 also includes, on the face designed to receive the arch segment(s) 7, chocks 45 configured to prevent the arch segment(s) 7 from moving. These chocks 45 are formed here of inclined walls configured to come into contact with the convex face of the arch segments 7. The chocks 45 can be planar or, as a variant, concave so as to conform to the convex shape of the face opposite the arch segments 7. They can be fixed or removable according to which is desired for the cart.

In the example of FIG. 4*b*, the cart 40 comprises only the two parallel bars 43, at the end of each of which are fixed one or two railway wheels 42. The bars 43 are connected to one another by one or more flexible connecting members 46. Here, the connecting member 46 comprises a chain. The cart 40 also includes, on the face designed to receive the arch segment(s) 7, chocks 45 configured to prevent the arch segment(s) from moving. These chocks 45 can be substantially identical to those described previously.

When the trailer 10 comprises only one pair of rails 32, the support 40 brings the arch segments 7 by moving along the rails 32 toward the front of the trailer 10 (i.e. in the direction of the shield 2), where the arch segments 7 are unloaded, then returns by moving along the same rails 32 until the rear of the trailer 10 so as to allow itself to be reloaded with new arch segments 7.

When the trailer 10 in question is the central trailer 10 closest to the shield 2, the support 40 is unloaded by a mechanism configured to place the arch segments 7 at the disposition of the erector for the purpose of their attachment to the wall of the tunnel.

Figure 5A:
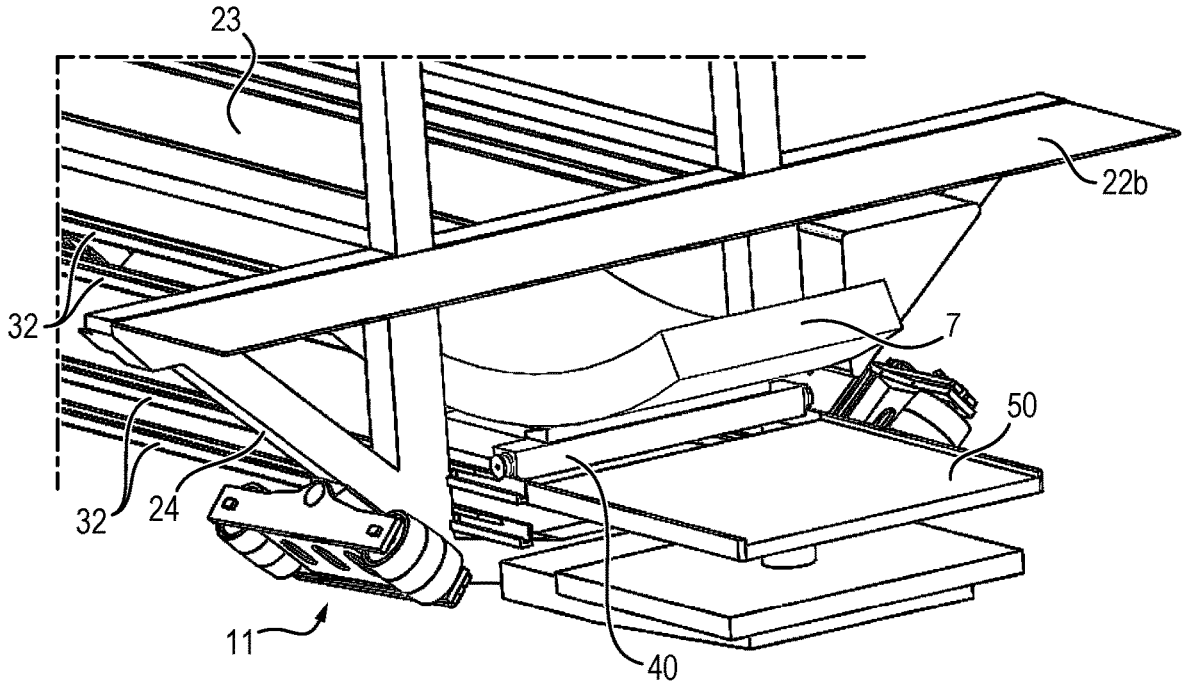
FIGS. 5*a*, 5*b* et 5*c* illustrate the support of FIG. 4*a* during its arrival at the front of the backup train (FIG. 5*a*), the unloading of the arch segment (FIG. 5*b*) and the return of the empty support (FIG. 5*c*).
Figure 5B:
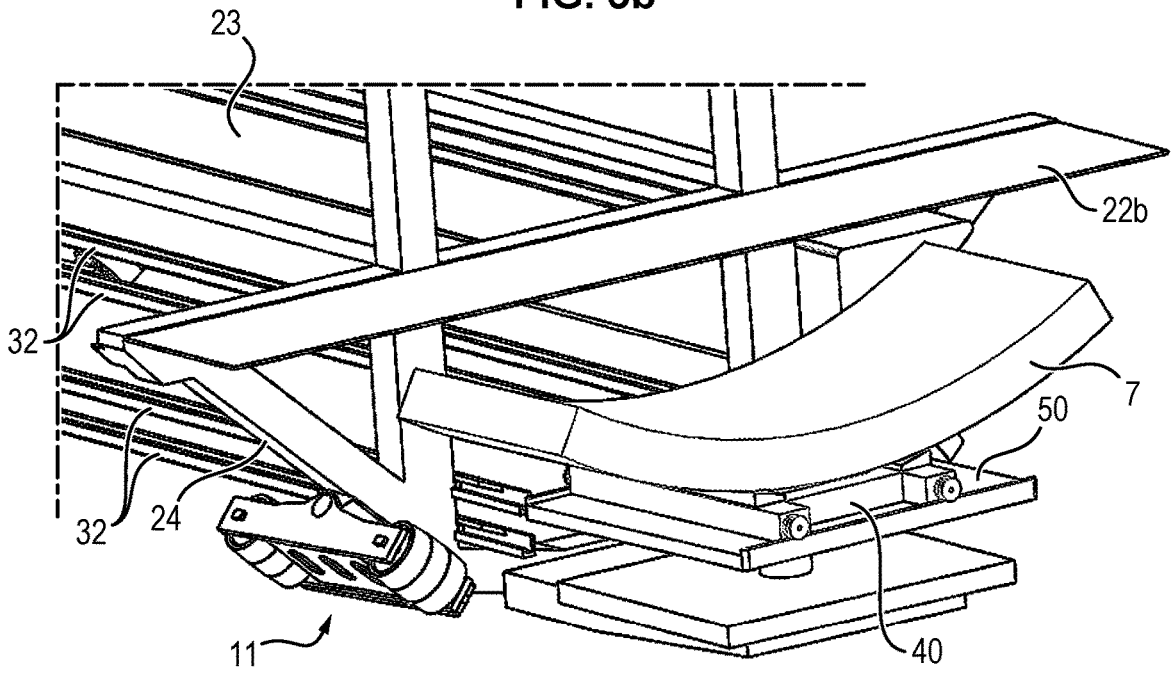
Figure 5C:
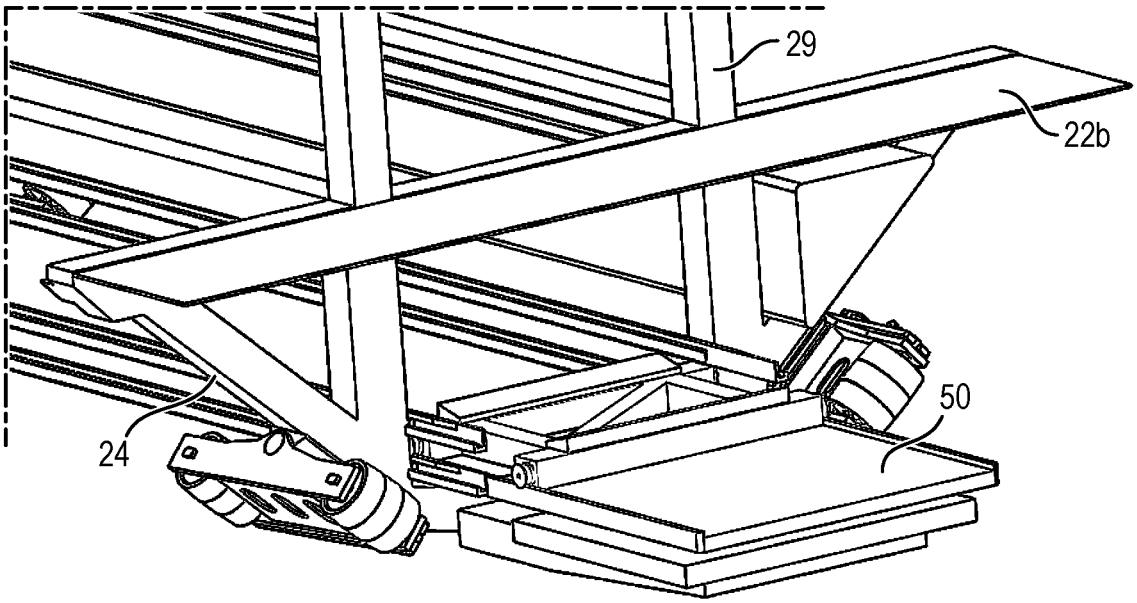

In one variant of this embodiment, illustrated for example in FIGS. 5*a* to 5*c*, the conveying means 30 comprise two superimposed paths formed of two pairs of rails 32 extending in parallel, two by two, one of the pairs of rails 32 being configured to transport the support 40 loaded with arch segments 7 toward the shield 2 while the other pair of rails 32 is configured to return the support 40, empty, to the rear of the backup train 3.

The pairs of rails 32 are preferably superimposed, i.e. they extend overall one above the other (in a vertical direction, that is perpendicular to the alignment of the tunnel). This configuration, in fact, allows a reduction in the ground-level bulk necessary for the conveying means 30 and the supports 40, while still allowing sufficient volume above the supports 40 to provide the corridor for the operators, maintenance and parts transportation. Typically, this configuration allows housing the conveying means 30 between the rolling means 11 in the lower portion 21 of the chassis 20.

In use, the support 40 is moved along the backup train 3 thanks to a first of the pairs of rails 32, for example the upper pair of rails 32. The support 40 goes up along the backup train 3 thanks to the upper pair of rails 32 until it reaches the farthest forward central trailer 10, in proximity to the suspended trailer (bridge) 8 and the erector. Arriving at the farthest forward central trailer 10, the support 40 leaves the rails 32 so as to allow its unloading and its return to the rear of the backup train 3, via the other pair of rails 32.

To this end, during a first step, a transfer plate 50 can be placed in the extension of the upper rails 32 so as to be able to receive the support 40 loaded with arch segment(s) 7 (FIG. 5*a*).

Then, during a second step, the support 40 is placed on the plate 50.

During a third, optional, step, the plate 50 can turn 90° so as to facilitate the gripping of the arch segment 7 by the erector (FIG. 5*b*). In fact, during its transport, the arch segment 7 is preferably placed on the support 40 so as to minimize its bulk in the direction perpendicular to its movement direction in the backup train 3. The arch segment 7 is therefore placed on the support 40 so that its greatest length is parallel to its direction of motion. In other words, during movement of the arch segment 7 in the backup train 3, the axis defining the curvature of the convex face of the arch segment 7 is perpendicular to the movement direction. Yet, to allow the installation of the arch segment 7 in the tunnel by the erector, it is necessary to turn the arch segment 7 90° with respect to its orientation during transport by the support 40.

During a fourth step, the arch segment 7 is then unloaded on a gripping table of the erector.

During a fifth step, the plate 50 is lowered so as to place it in the extension of the lower pair of rails 32, and again turned 90° (in one direction or in the other) so as to position the wheels 42 of the support 40 opposite the rails 32 (FIG. 5*b*).

During a sixth step, the support 40 is slipped onto the lower rails 32 and returned, empty, to the rear of the backup train 3.

The support 40 can comprise a motor configured to place in rotation all or part of its wheels 42 so as to allow its movement along the rails 32. As a variant, the support 40 can be passive and not comprise a motor, in which case it can be towed or pushed along the rails 32 by a motor placed on the backup train 3, on the shield 2 or even on an external portion of the tunnel boring machine 1, at the rear of the backup train 3.

Figure 6:
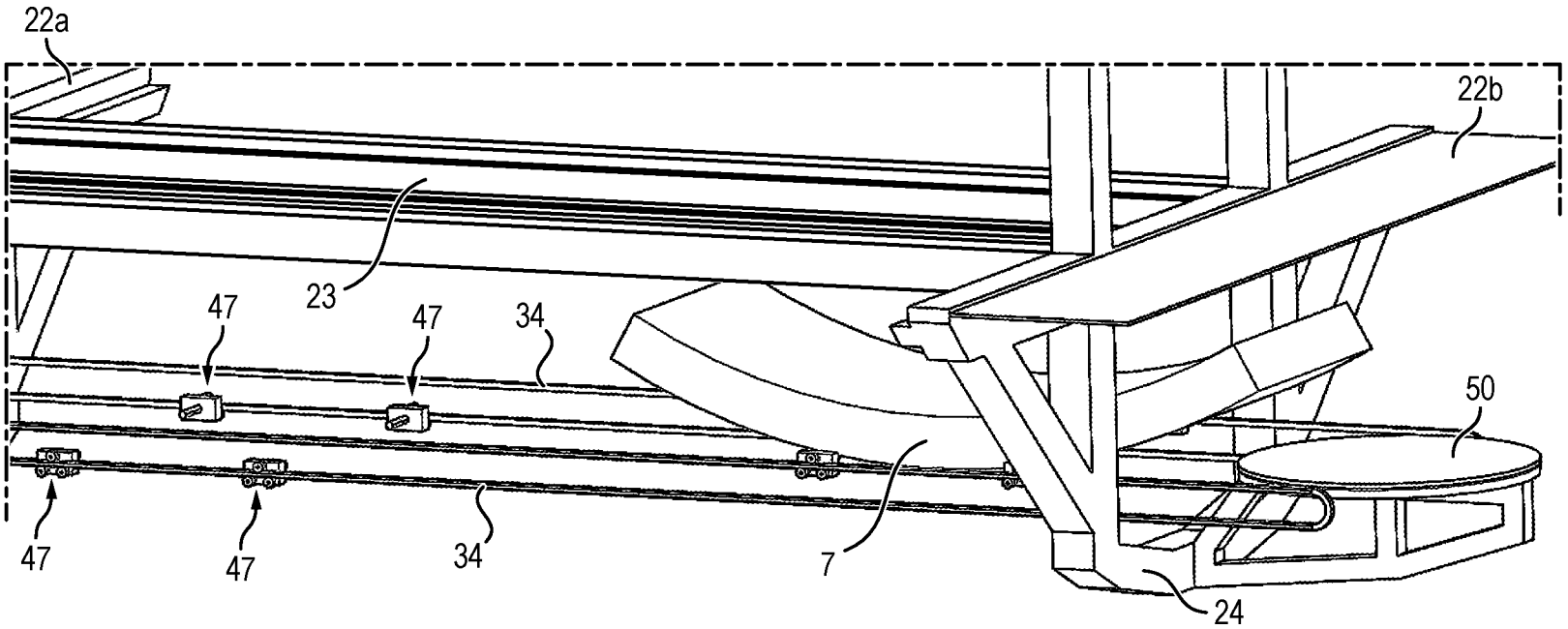
FIG. 6 illustrates a third exemplary embodiment of a support configured to carry an arch segment and an example of an associated means of conveyance when the support arrives at the front of the backup train.

In a second embodiment, illustrated in FIG. 6, the conveying means 30 comprise a conveyor 34. For example, the conveyor 34 can be of the chain-link conveyor 34 type and comprise a single conveyor belt forming two superimposed paths to which is fixed the support 40, typically a support plate, or as a variant comprise two chains moving at the same speed and on which are fixed studs 47 configured to carry, together, the arch segment(s) 7. In the exemplary embodiment illustrated in FIG. 6, the support 40 comprises two pairs of studs 47 fixed integrally to two chains and configured to support one or more arch segments 7. Here, the studs 47 have a substantially rectangular shape, a rod protruding from each of said studs 47, and the arch segment 7 is positioned in equilibrium on the four rods. If necessary, the studs 47 can be connected two by two so as to stiffen the support 40.

When the support 40 is attached to the conveyor 34, as is the case with a chain-link type conveyor 34, a single conveyor 34 can be sufficient to supply the erector with arch segments 7 then returning the support 40, empty. In fact, when the support 40 is located on the upper portion 26 of the conveyor 34, the arch segments 7 can be placed on the support 40 and brought to the erector, then, once the support 40 is unloaded, this can be returned while running through the lower portion 21 of the conveyor 34 by simply following the movement of the chain(s). It is therefore unnecessary to transfer the supports 40 for the purpose of their return to the rear of the backup train 3, these being fixed to the conveyor 34. However, the arch segment 7 also being placed on the support so that its greatest length is parallel to its direction of movement so as to minimize its bulk, receiving the arch segment 7 on a rotating plate 50 can be considered, so as to make it rotate 90° prior to its gripping by the erector. It will be understood that here the plate 50 can be only a rotating plate and that it is not necessary that this place be capable of moving vertically.

According to another variant embodiment (not visible in the figures), the conveyor 34 can comprises a frame and:

a set of conveying rollers mounted in rotation on the frame around an axis substantially perpendicular to the conveying direction of the arch segments 7, a set of spherical balls mounted free in rotation on the frame, a set of spherical balls mounted in rotation on the frame around an axis substantially perpendicular to the conveying direction of the arch segments 7.

In this variant embodiment, the support 40 then has a smooth lower face configured to slide on the conveying rollers or the spherical balls and form an interface with the rollers or the balls so as not to risk damaging the arch segments 7 during their movement. Furthermore, the support 40 is passive and is towed or pushed along the conveyor 34 by a motor placed on the backup train 3, on the shield 2 or even on an external portion of the tunnel boring machine 1, at the rear of the backup train 3.

Thanks to the conveying means 30 fixed to the trailer 10 and the use of supports 40 instead of a backup train 3 to supply the erector with arch segments 7, it is possible to modify the configuration of the trailers 10 so as to optimize the positioning of the different operating modules 6 and to create one or more corridors 12 for operators, maintenance operations and parts transport.

Illustrated for example in FIG. 1 is an exemplary embodiment of a chassis 20 of a trailer 10 which can be implemented in this invention.

The chassis 20 comprises the lower portion 21 and the upper portion 26 described earlier.

The lower portion 21 comprises here a front cross-member 22*a* and a rear cross-member 22*b* extending substantially parallel to one another and connected together by a central plate 23. The front cross-member 22*a* and the rear cross-member 22*b* are used to fix platforms configured to each receive one or more operating modules 6.

Furthermore, the front cross-member 22*a* and the rear cross-member 22*b* extend substantially perpendicular to the movement direction of the trailer 10 in the tunnel. As we will see hereafter, the central plate 23 can serve as a base for the transport of equipment, of personnel, etc. To this end, the central plate 23 can in particular be equipped with one or more rails 32 extending along the movement direction of the trailer 10, so as to allow the transport of heavy loads and/or of light loads.

The lower portion 21 also comprises a front structure 24, on which are fixed front rolling means, the front end of the conveying means 30 of the trailer 10 and the front cross-member 22*a*, and a rear structure 24, on which are fixed the rear rolling means 11, the rear end of the conveying means 30 of the trailer 10 and the rear cross-member 22*b*.

More precisely, each structure 24 includes a C-shaped base configured to take up the compression forces of the trailer 10. Moreover, the C-shaped base 24 comprises an external face (adapted to extend opposite the circulation route 5) on which are fixed the rolling means 11. The C shape of the structure 24 allows adapting the chassis 20 to the circular shape of the tunnel bored by the cutting head.

Each cross-member is fixed to the corresponding structure 24 at the free ends of the C-shaped base 24. The conveying means 30 are then fixed to the internal face of the C-shaped base 24, in its lower portion, between the rolling means 11.

In the case where the conveying means 30 comprise two pairs of rails 32 or two pairs of conveyors 34 in parallel (the case in particular of the roller or ball conveyors 34), said pairs of rails 32 (or of conveyors 34) are then attached one above the other, by providing a sufficient space between the upper pair and the central plate 23 (respectively between the lower pair and the upper pair) to allow the passage of the support 40 equipped with the number of arch segments 7 desired, and between the upper pair and the lower pair (respectively between the upper pair and the central plate 23) to allow the passage of the support 40 when empty.

As a variant, in the case of the chain-link conveyor 34, said conveyor is fixed to the C-shaped base 24 by providing sufficient space between its upper face and the central plate 23 to allow the passage of the support 40 equipped with the desired number of arch segments 7, and between its lower face and the ground to allow the passage of the support 40 when empty.

If necessary, each structure 24 also includes two vertical legs 25 fixing the associated cross-member to the C-shaped base 24. The conveying means 30 can then be fixed between these two legs 25.

The upper portion 26 of the chassis 20 comprises, similarly to the lower portion 21, a front cross-member 27*a* and a rear cross-member 27*b*. These cross-members 27*a*, 27*b* are connected together by lateral cross-members 28. The front 27*a*, rear 27*b* and lateral 28 cross-members are used to fix platforms configured to each receive one or more operating modules 6.

The upper portion 26 is fixed to the lower portion 21 by means of structural legs 29 extending vertically between the front 22*a*, 27*a* and rear 22*b*, 27*b* cross-members of each portion 21, 26. If necessary, these structural legs 29 extend in the continuation of the legs 26 of the structures 24.

A backup train 3 conforming to an embodiment of the invention can thus comprise, in a non-limiting manner, from the front to the rear, starting from the shield 2:

a suspended trailer 8 (bridge), connected to an erector, at least one central trailer 10, comprising operating modules 6, preferably between four and five central trailers 10, and at least one rear trailer 9 configured to load arch segments 7, for example two rear trailers 9.

Figure 3:
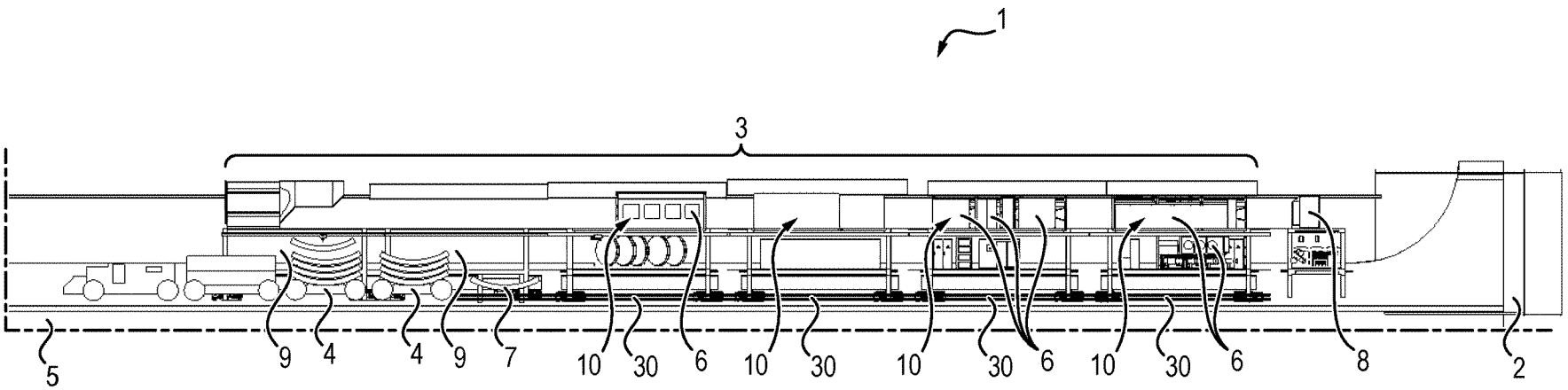
FIG. 3 is a schematic side view illustrating a tunnel boring machine comprising examples of trailers conforming to the invention.

The central trailers 10 each comprise conveying means 30 as described above. At least one support 40 is placed on these conveying means 30 so as to transport at least one arch segment 7. The backup train 3 can comprise one or more supports 40 per central trailer 10 (see FIG. 3).

In order to allow the passage of the support 40 from a central trailer 10 to the next central trailer 10 and to take up the forces between the two central trailers 10, a connecting bridge 60 can be provided between the conveying means 30 of said central trailers 10.

In the case of conveying means 30 comprising a conveyor 34, and more particularly a chain-link conveyor 34, the chain(s) of the conveyor 34 can simply extend along the set of central trailers 10 so as to allow the passage of the support 40 from the central trailer 10 farthest to the rear to the central trailer 10 farthest in front. These chains being relatively flexible, they adapt to possible relative movement between two adjacent trailers 10 (due in particular to turns, ground irregularities and slopes) without breaking, while still ensuring the passage of the support 40 from one central trailer 10 to the next. The connecting bridge 60 between two adjacent trailers 10 is therefore formed by the conveyor 34 itself.

In the case of conveying means 30 comprising one or more rails 32, the presence of a connecting bridge 60 capable of compensating possible relative movements between two adjacent central trailers 10 is preferable, the rails 32 being rigid and having difficulty in deforming without breaking. For example, the connecting bridge 60 can comprise a rail portion 61, of which the thickness and if necessary the height and the constitutive material are substantially the same as that (those) of the rails 32 of the trailers 10.

The rail portion 61 is then mounted on the rail 32 of the central trailers 10 which it connects by means of two mechanical joints 62, 65. The first mechanical joint 62 can comprise one of the following joints:

a single pivot joint of which the pivot axis is vertical (that is substantially perpendicular to a circulation route 5). This joint thus allows compensation for the relative rotations of the central trailers 10 in turns.

a double pivot joint comprising one pivot the axis of which is vertical and one pivot the axis of which is horizontal (parallel to the circulation route 5) and transverse to the direction of movement. This joint thus allows compensation for the relative rotations of the central trailers 10 in turns as well as those resulting from a slope.

a ball joint, so as to compensate for the relative rotations of the central trailers 10 in turns as well as those resulting from a slope.

If necessary, the first mechanical joint 62 also comprises a sliding joint 64 so as to compensate for length clearances induced by the curves of the tunnel.

The second mechanical joint 63 can comprise a single pivot joint, a double pivot joint, a ball joint or an interlocking joint.

Figure 7:
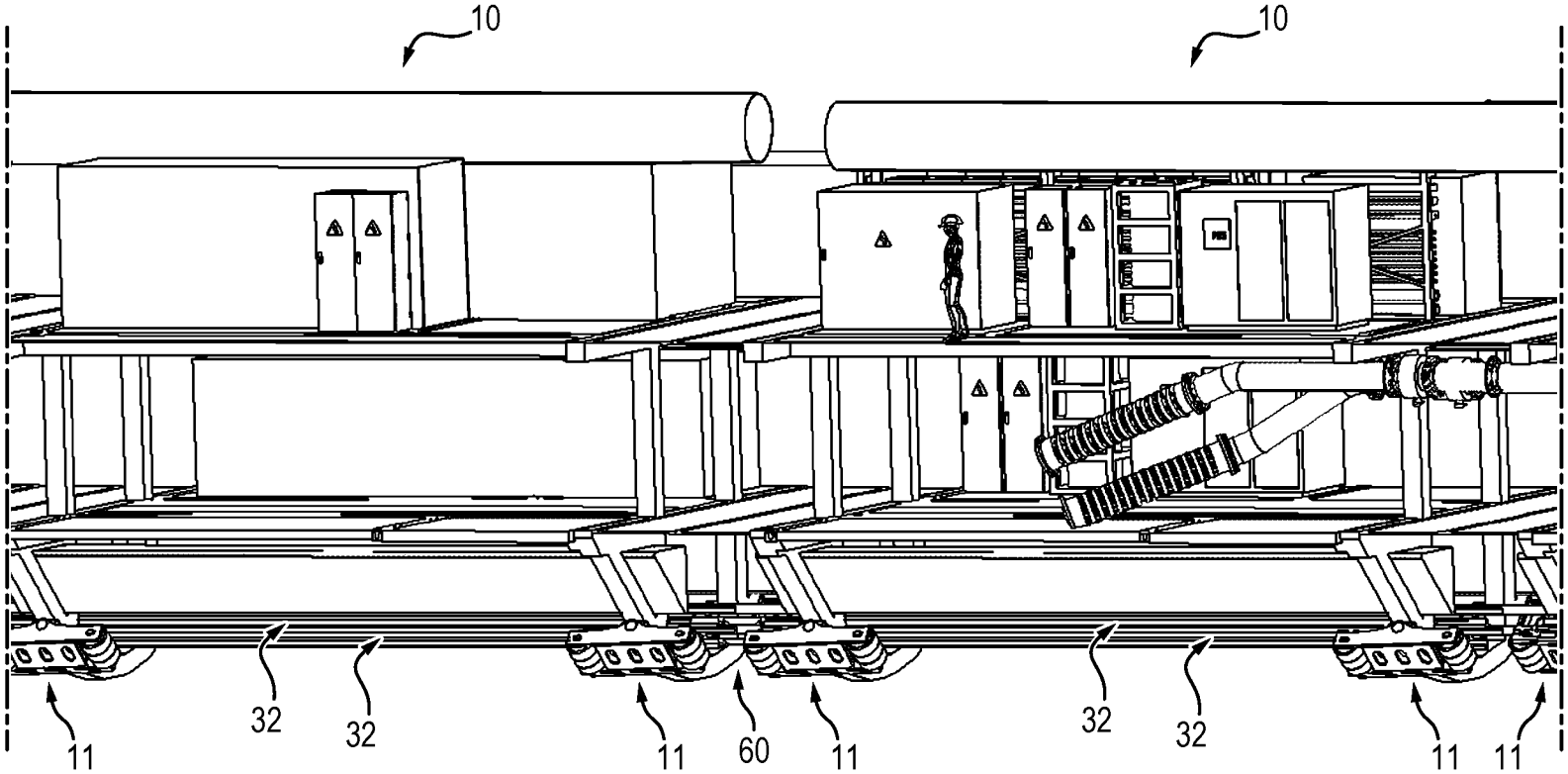
FIG. 7 illustrates two examples of trailers conforming to the invention comprising examples of operating modules as well as an example of a connecting bridge between conveying means.
Figure 8:
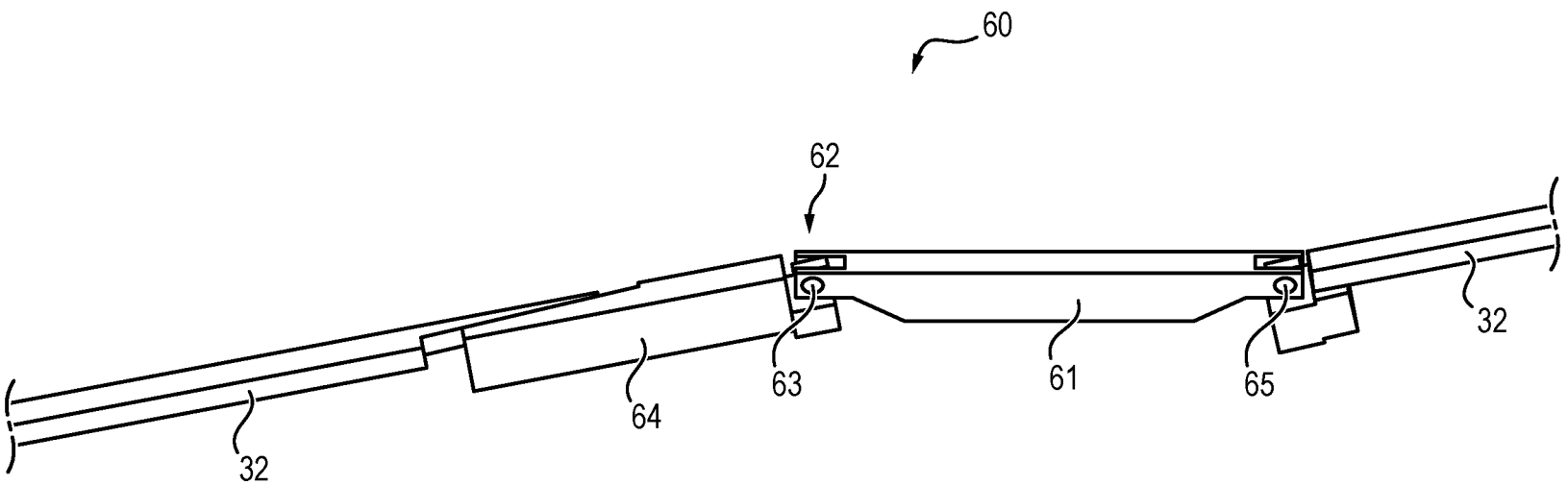
FIG. 8 is a detail view of one of the connecting bridges of FIG. 7 in a sloping turn.

In the embodiment illustrated in FIGS. 6 and 7, the first mechanical joint 62 comprises a double pivot joint 63 and a sliding joint 64 while the second mechanical joint 65 comprises a double pivot joint. As can be seen in particular in FIG. 7, which illustrates the configuration of the connecting bridge 60 while the adjacent central trailers 10 are taking a sloped turn, the rail portion 61 pivots around the horizontal axis to take up the rotation forces due to the slope and around the vertical axis to take up the forces in rotation applied to the rails 32 of the trailers 10 which are due to the turn. For its part, the sliding joint 64 has extended itself so as to take on the length clearances induced by the turn.

Preferably, in the case where such a connecting bridge 60 is used, the support 40 comprises railway wheels 42 with double flanges so as to guarantee the stability and guidance of the support 40 during its passage on the connecting bridge 60.

The rear trailers 9 comprise, conventionally, an internal passage which allows the introduction of an MSV 4 into said trailers 10 so as to bring the arch segments 7 to the central trailers 10.

In use, arch segments 7 are brought by an MSV 4 to the backup train 3, from the rear thereof. The MSV 4 enters into the rear trailer 9, for example by rolling on an inclined plane, passes through it to reach the first central trailer 10, where the arch segments 7 are unloaded, either directly onto one or more supports 40, or onto a standby device before being placed on one or more supports 40. The supports 40 are then placed successively on the conveying means 30 of this first central trailer 10, then moved (either by their own means or by means of a motor, either by the conveying means 30 themselves (particularly in the case of a chain-link conveyor), or by means external to the support 40 and to the conveying means 30) so as to transport the arch segments 7 along the first trailer 10 then along the next central trailers 10 via the connecting bridges 60, until the suspended trailer (bridge) which is situated all the way forward. Each support 40 can transport one or more arch segments 7 at a time. In one embodiment, each support 40 transports a single arch segment 7 at a time, so as to reduce the vertical dimension necessary for the passage of the arch segments 7 and to thus increase the volume available for the central corridor 12.

In parallel, optionally, the MSV 4 can reverse to go fetch additional arch segments 7, then return, once loaded, to the first trailer 10 while passing through the rear trailer 9 so as to unload the additional arch segments 7 onto the supports 40. These supports 40 will then follow the already loaded supports 40 toward the front of the backup train 3. It is possible to renew the loading of supports 40 until there is no more room on the conveying means 30 of the backup train 3 for an additional support 40.

It will be noted that, thanks to the use of central trailers 10 comprising conveying means 30, the MSV 4 now needs only to pass into one, or two conventional rear trailers 9. It is the supports 40 which will advance progressively in the backup train 3, passing from one central trailer 10 to another. Advantageously, supports 40 can be stored consecutively in the central trailers 10, so that the backup train 3 can transport a large number of arch segments 7 at the same time, this number sometimes being sufficient to accomplish a complete ring of the arch segments 7 covering the entire periphery of the tunnel to be produced.

Figure 2:
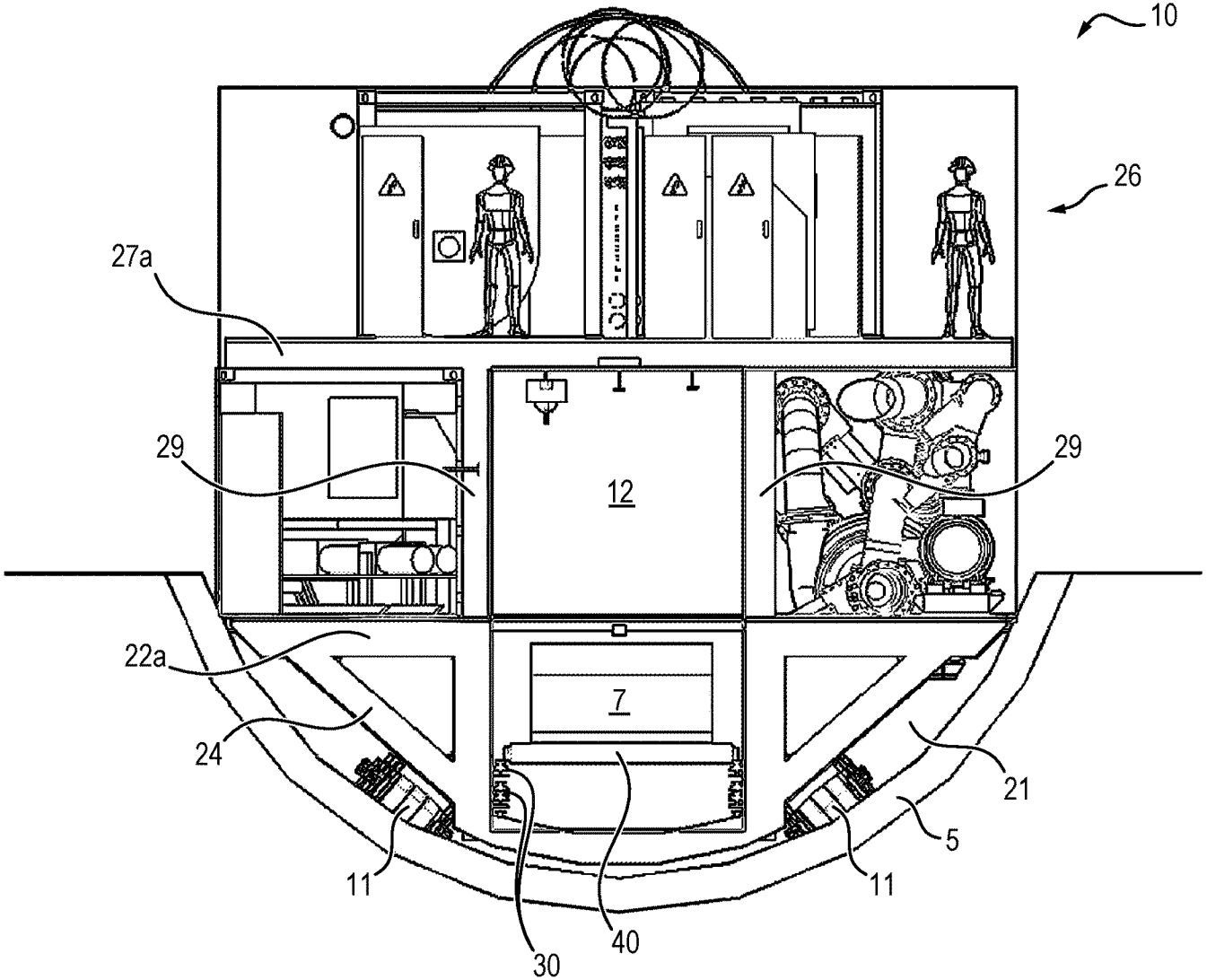
FIG. 2 is a section view of a trailer illustrated in FIG. 1 and on which have been schematically shown examples of operating modules as well as an example of a support carrying arch segments.

Moreover, insofar as the MSV 4 stops at the entrance of the first central trailer 10 to unload arch segments 7 there, and that these arch segments 7 are transported in the lower portion 21 of the chassis 20 of the central trailers 10 thanks to the conveying means 30, it is no longer necessary to provide for a central recess in the chassis 20 so as to allow the circulation of the MSV 4 through the central trailers 10. Only a limited passage, in the lower portion 21, remains necessary to accommodate the conveying means 30 and the support(s) 40 and thus allow the supply of the arch segments 7. A portion of the volume initially used to allow the circulation of the MSV 4 can therefore be converted into storage space for operating modules 6 and/or into passage for operators, maintenance corridors, etc. In the exemplary embodiment illustrated in the figures, the volume thus recovered (with respect to the passage volume provided in the rear trailer 9 for the MSV 4) corresponds to the central corridor 12, which is delimited by the central plate, the legs 26 and the upper portion 26 of the chassis 20 (front, rear and lateral cross-members) (see FIG. 2). This central corridor 12 thus allows the operators to circulate on a different path than that used by the transport means of the arch segments, which eliminates the risks of coactivity between the operators and the different vehicles. This passage also simplifies the logistical operations, facilitating in particular the maintenance operations and the transport of consumables.

The invention claimed is:

1. A backup train of a tunnel boring machine including at least two trailers comprising:

rolling means configured to allow movement of the trailer on a circulation route, a chassis including a lower portion comprising the rolling means and an upper portion, opposite to the rolling means, conveying means, fixed in the lower portion of the chassis, wherein said conveying means comprise two superimposed paths configured to move at least one support along the trailer, said support being configured to transport at least one arch segment along the chassis, the backup train further comprising a connecting bridge configured to connect the conveying means of one of the trailers to the conveying means of the other of the trailers so as to allow the transfer of at least one arch segment along the two trailers via their respective conveying means, wherein the conveying means of the two trailers each comprise at least one rail and wherein the connecting bridge between said rails comprises a portion of rail fixed to each of the rails by means of mechanical joints including a sliding joint and at least one of the following joints: a single pivot joint, a double pivot joint, a ball joint.

2. The backup train according to claim 1, wherein the conveying means extend between the rolling means of the trailer.

3. The backup train according to claim 1, wherein the conveying means comprise at least one rail and/or at least one conveyor.

4. The backup train according to claim 3, wherein the superimposed paths comprise two pairs of rails extending in parallel two by two, the two pairs of rails being superimposed.

5. The backup train according to claim 1, wherein the conveying means is a chain-link conveyor, the chain forming the two superimposed paths, the support then being configured to be fixed to the conveying means and driven by said conveying means.

6. The backup train according to claim 1, comprising a central corridor configured to allow circulation of an operator, said central corridor extending above the conveying means.

7. The backup train according to claim 1, comprising a rotating plate configured to receive a support configured to transport at least one arch segment along the chassis, said rotating plate being configured for turning the support so as to facilitate gripping by an erector of an arch segment carried by the support.

8. The backup train according to claim 7, wherein the conveying means comprise two superimposed pairs of rails, the rotating plate also being configured to move the support vertically and transfer it from one of the pairs of rails to the other.

9. A backup train of a tunnel boring machine comprising at least one trailer of a backup train of a tunnel boring machine comprising:

rolling means configured to allow movement of the trailer on a circulation route, a chassis including a lower portion comprising the rolling means and an upper portion, opposite to the rolling means, conveying means, fixed in the lower portion of the chassis, wherein said conveying means comprise two superimposed paths configured to move at least one support along the trailer, said support being configured to transport at least one arch segment along the chassis, wherein the backup train further comprises a rotating plate configured to receive a support configured to transport at least one arch segment along the chassis, said rotating plate being configured for turning the support so as to facilitate gripping by an erector of an arch segment carried by the support, wherein the conveying means comprise two superimposed pairs of rails, the rotating plate also being configured to move the support vertically and transfer it from one of the pairs of rails to the other.

10. The backup train according to claim 9, wherein the conveying means extend between the rolling means of the trailer.

11. The backup train according to claim 9, wherein the superimposed paths comprise two pairs of rails extending in parallel two by two, the two pairs of rails being superimposed.

12. The backup train according to claim 9, comprising a central corridor configured to allow circulation of an operator, said central corridor extending above the conveying means.

13. The backup train according to claim 9, comprising at least two trailers and a connecting bridge configured to connect the conveying means of one of the trailers to the conveying means of the other of the trailers so as to allow the transfer of at least one arch segment along the two trailers via their respective conveying means.

14. The backup train according to claim 13, wherein the conveying means of the two trailers each comprise at least one rail and wherein the connecting bridge between said rails comprises a portion of rail fixed to each of the rails by means of mechanical joints including a sliding joint and at least one of the following joints: a single pivot joint, a double pivot joint, a ball joint.

15. A tunnel boring machine comprising a backup train according to claim 9.

* * * * *